US008048243B2

(12) United States Patent
Lipstein

(10) Patent No.: US 8,048,243 B2
(45) Date of Patent: Nov. 1, 2011

(54) COMBUSTION CATALYST

(75) Inventor: Evan Lipstein, New York, NY (US)

(73) Assignee: Evan W. Lipstein, New York, NY (US)

( * ) Notice: Subject to any disclaimer, the term of this patent is extended or adjusted under 35 U.S.C. 154(b) by 0 days.

(21) Appl. No.: 12/328,124

(22) Filed: Dec. 4, 2008

(65) Prior Publication Data

US 2011/0155028 A1 Jun. 30, 2011

(51) Int. Cl.

| | |
|---|---|
| ***C06B 31/00*** | (2006.01) |
| ***C06B 31/02*** | (2006.01) |
| ***D03D 23/00*** | (2006.01) |
| ***D03D 43/00*** | (2006.01) |

(52) U.S. Cl. ..... 149/109.6; 149/45; 149/61; 149/108.4; 149/109.2

(58) Field of Classification Search ..... 149/109.2, 149/45, 61, 108.4, 109.6
See application file for complete search history.

(56) References Cited

U.S. PATENT DOCUMENTS

2007/0168213 A1* 7/2007 Comrie ..... 705/1

* cited by examiner

*Primary Examiner* — James McDonough

(57) ABSTRACT

The present invention pertains to combustion catalysts, including processes for achieving increased thermal output from combustion processes, processes for improved combustion in boilers and furnaces, processes for reducing the emission of undesirable pollutants, and processes for increasing the combustion of carbon.

6 Claims, No Drawings

COMBUSTION CATALYST

FIELD OF THE INVENTION

The present invention relates generally to catalysts used to aid combustion processes.

BACKGROUND OF THE INVENTION

The demand for energy is increasing significantly worldwide. To help satisfy this demand for energy, and due to increased energy costs, there is a desire to increase the thermal output in the burning of fossil fuels, particularly solid hydrocarbon fuels, such as in furnaces, boilers or the like. Also, there are several drawbacks to burning fossil fuels such as coal, a significant one of which is the generation of undesirable combustion emissions. There is a need for something which can increase the thermal output in combustion processes, and reduce undesirable emissions such as NOx.

SUMMARY OF THE INVENTION

In accordance with the present invention, various advantageous formulations and methods of using such formulations are provided for enhancing the combustion of fossil fuels such as coal, oil, natural gas, wood and charcoal, to increase the thermal output of furnaces, boilers and the like in which such fuels are burned. In accordance with other aspects of the invention, combustion catalyst formulations and processes are provided which act to reduce slagging, fouling, reduce sulfur trioxide and sulfur dioxide emissions, reduce the required excess air in the combustion process, reduce the formation of NOx, reduce fuel consumption, and reduce CO production.

DESCRIPTION OF THE INVENTION

The following description is provided to enable those skilled in the art to carrying out the invention. Various modifications, equivalents, variations, and alternatives, however, will remain readily apparent to those skilled in the art. Any and all such modifications, variations, equivalents, and alternatives are intended to fall within the sprit and scope of the present invention.

It has been surprisingly found that a combustion catalyst composed of hydrous aluminum silicate comprised principally of the clay mineral montmorillonte, and having a specific moisture content, dry particle size, wet particle size, pH, viscosity and bulk density, mixed in accordance with a specific mixing protocol in exact proportions with a dodecohydrate provides excellent combustion enhancement as well as reduction of undesirable emission components. Also, it has been found that the following formulation, when properly injected into the combustion chamber, provides the benefits of increasing efficiency of boilers and similar devices by up to five percent, reducing fuel consumption, allowing greater steam production and lowering maintenance costs by reducing slagging and fouling:

Sodium Nitrate 12%-18%
Potassium Permanganate 0.2%-0.4%
Sodium carbonate 0.5%-1.5%
Silicon Dioxide 40%-65%
Ferrous Oxide 3%-5%
Magnesium Oxide 2%-5%
Potassium Oxide 0.3%-0.8%
$Al_2O_2$ 20%-24%
$Fe_2O_3$ 2.6%-5.3%

(In which all % are based on weight)

Certain formulations of the present invention also include various finely divided powdered materials with a bulk density of about 75 lbs. per cubic foot. Chemically, such formulations of the present invention may be made by a combination of alkaline-earth materials, oxides of alkali metals, kaolin and colloidal clays.

Injecting formulations consisting of the combination of ingredients falling into these ranges, into the combustion chamber of a boiler in a temperature range between 1800 F. to 2100 F. closely adjacent to the injection of fuel and combustion air, or directly upon the fuel in certain circumstances, has been found to increase the efficiency of the combustion and thereby increase the efficiency of the boiler by up to 5%, while providing the ancillary benefits of reduced particulate and undesirable emission components.

When the inventive formulas of the present invention are made from dry powdered ingredients and used as an enhancer or catalyst additive which is added to dry sorbents injected into a furnace burning sulfur bearing fuels for the purpose of converting sulfur dioxide gases to calcium—or if injected into the cooler flue gas passages, to sodium sulfate precipitates—which can be collected as ash components, the yields of sulfates can be increased as much as 60% without utilizing additional sorbent injection.

The inventive formulas of the present invention, and the methods of their usage, allow for significant improvement in the yields of calcium and/or sodium sulfate precipitates in the process of flue gas desulfurization, thereby significantly increasing the effectiveness of desulfurization processes.

The inventive formula contains regenerative oxidizing agents which give up their oxygen to the carbon at temperatures less than normal ignition temperatures and re-oxidizes itself with oxygen in the air to regenerate itself. Thus, the inventive formula acts as a catalyst in combustion processes since it does not add anything to the carbon-oxygen chemistry, but rather only acts to speed up the combustion process. However, since it does react at temperatures as low as 600 F. (315 C.) cold-end soot and carbon deposits are consumed when using the inventive formulation which generates still further usable heat, which is an added benefit of the formulations of the present invention. The combustion catalyst of the present invention oxidizes carbon at a temperature which is considerably lower than normal, which allows the carbon to be burnt instead of deposited on the combustion chamber walls. Because the combustion catalyst of the present invention does not burn and is regenerative, a great deal of use may be made out of a relatively small quantity of the catalyst.

In a multiple boiler arrangement, the combustion catalyst may be supplied by semi-automatic feeder units attached to each of several boilers. When in use, the low pressure boilers use approximately ½ pound of the combustion catalyst per day, and the high pressure boilers use ¾ pound per day.

Even though the compositions of various fuels varies widely, even from one batch of coal to another, the combustion catalyst of the present invention has been found to achieve its beneficial characteristics for all types of fuels.

In most coal fired furnaces, 20%-30% of the coal is not completely burned in the combustion process. It has been found that the usage of the inventive formulas of the present invention improve the combustion of the carbon contained in the fossil fuel up to nearly 100%, reducing the carbon emission of unburned particulate matter to the atmosphere.

The injection or other application of the inventive formulations of the present invention into the combustion process will reduce the acid dew point which causes cold end corrosion, assist in the removal of NOx from SCR systems, and reduce the temperature of the flue gases being emitted to the atmosphere.

The formulations of the present invention can achieve significant improvements when added to the sorbent in quantities of less than 1% by weight. In applications utilizing grade coal and low firing rate applications, up to 5% may be used.

The reduction in excess air and fuel consumed with the use of the combustion catalyst formula of the present invention will result in a lowering of the flue gas temperature and volume. Reduction in the combustion temperature has been found to prevent the formation of NOx emissions. Also, on existing systems, this means the equipment originally sized for a higher volume and temperature will now perform more efficiently thus removing more pollutants than originally designed.

The formulas of the present invention can achieve outstanding sulfate reductions by being injected with the fuel or into the combustion zone to pre-catalyze the sulfur dioxide components and/or by being premixed with the sorbent to catalyze the calcining reaction and calcium oxide to calcium reaction. A similar improvement may be achieved with either of these methods.

In fluidized bed applications where coal and sorbent are fed into a controlled temperature bubbling combustion bed, the formulations of the present invention can be added directly to the bed with the coal or other fuel and a sorbent, because the control temperature is consistent with the calcining temperature of the sorbent.

In addition to the catalytic effect of the formulations of the present invention, in combination with the use of such formulations it may be advantageous in certain situations to simultaneously control the rate or volume of the intake air, and/or to control the rate or volume of the exhaust from the combustion chamber. It has been found that the use of the catalytic formulations of the present invention in combination with boiler-incinerator-smokestack systems.

When used in accordance with the methods of the present invention, the formulations of the present invention will provide more heat from the fuel than the fuel would get without the formulations of the present invention. When used in accordance with another aspect of the present invention, the formulations can significantly reduce, or eliminate carbon and soot deposits within the combustion chamber, tubes, flues and stack.

An improvement in the heat transfer characteristics of a boiler may be achieved in two ways: by removing or altering the slag deposits in the boiler or by changing the heat transfer effects of the combustion gases.

Calorimetry tests conducted on various fuels have indicated that the formulations of the present invention consistently provide a 3% heat increase. This increase can be translated directly into fuel savings.

The catalytic formulations of the invention are capable of oxidizing carbon at a temperature considerably lower than normal ignition temperature. Therefore, soot and carbon deposits are literally burned off with a low temperature oxidizing action. And since certain portions of the formulation are regenerative in that it can, once reduced, reoxidize at low temperature to react again with other carbon materials. When conventional coal-fired, natural-draft boilers were used with the catalytic formulations of the present invention, blue flames danced across the walls of the boiler as it cooled down. This is characteristic of the soot removing action which is possible with the present invention in which soot and carbon deposits are turned into usable heat.

The alkaline metals in the formulations of the present invention have a characteristic that causes an alloying action to occur with slag formations both new and existing. That material which remain as on the tubes and walls turns gray in color softens to a cigar-like and either falls off, or is easily removed. In either case, the result is improved heat transfer efficiency, i.e. less fuel is required to maintain demand loads. This savings may be even more substantial than the heat-release improvements, depending on the initial boiler conditions.

While many various means may be used to introduce the combustion catalyst of the present invention into the combustion chamber may be either the combustion air system, the fuel injection system, or a separate injection system consisting of a flow metering device and a compressed air supply and conveying piping or as an alternate a Dense Phase transport system.

The sulfur emission reductions realized by the formulations of the present invention have been demonstrated to be up to 60%, with combustion catalyst feed rates of just 0.5% to 3% of the fuel feed rate.

What is claimed is:

1. A process for improved combustion in boilers and furnaces, the process comprising:

Formulating a combustion catalyst, comprising:

Sodium Nitrate 12%-18%

Potassium Permanganate 0.2%-0.4%

Sodium carbonate 0.5%-1.5%

Silicon Dioxide 40%-65%

Ferrous Oxide 3%-5%

Magnesium Oxide 2%-5%

Potassium Oxide 0.3%-0.8%

$Al_2O_2$ 20%-24% and $Fe_2O_3$ 2.6%-5.3%; and injecting the combustion catalyst into the combustion reaction in a temperature range between 1900 F. to 2100 F.

2. A process for increasing the combustion of carbon contained in a fuel by up to 100% while also reducing the carbon emissions of particulate matter to the atmosphere, comprising injecting the combustion catalyst of claim 1 into the combustion process.

3. A process for reducing the temperature of flue gases emitted from a boiler into the atmosphere, comprising injecting the combustion catalyst of claim 1 into the combustion process.

4. A process for reducing excess air and fuel consumed in a combustion process so as to lower the temperature and volume of the flue gases being emitted to the atmosphere, comprising injecting the combustion catalyst of claim 1 into the combustion process.

5. A process for achieving an increase in the removal of pollutants on existing systems using equipment originally sized for a higher volume and temperature, comprising injecting the combustion catalyst of claim 1 into the combustion process.

6. A process for reducing the production and emission of SO2, SO3, CO and NOx gases in the burning of fossil fuels, comprising injecting the combustion catalyst of claim 1 into the combustion process.

* * * * *